United States Patent [19]

Gross

[11] 4,035,687

[45] July 12, 1977

[54] TRAVELING WAVE TUBE HAVING A HELIX DELAY LINE

[75] Inventor: Franz Gross, Munich, Germany

[73] Assignee: Siemens Aktiengesellschaft, Berlin & Munich, Germany

[21] Appl. No.: 672,312

[22] Filed: Mar. 31, 1976

[30] Foreign Application Priority Data

Apr. 15, 1975 Germany ..... 2516428

[51] Int. Cl.[2] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 3,369,191 | 2/1968 | Schram et al. | 315/3.5 X |
| 3,387,168 | 6/1968 | Beaver | 315/3.5 |
| 3,397,339 | 8/1968 | Beaver et al. | 315/3.5 |
| 3,670,197 | 6/1972 | Unger | 315/3.5 |
| 3,903,449 | 9/1975 | Scott et al. | 315/3.5 |
| 3,940,654 | 2/1976 | Winslow | 315/3.6 |
| 3,972,005 | 7/1976 | Nevins, Jr. et al. | 315/3.5 |

*Primary Examiner*—Saxfield Chatmon, Jr.

*Attorney, Agent, or Firm*—Hill, Gross, Simpson, Van Santen, Steadman, Chiara & Simpson

[57] ABSTRACT

A traveling wave tube has a helical delay line which is supported by a plurality of dielectric support rods extending along the delay line. The delay line and support rods are housed within a metallic sleeve which has an enlarged diameter in the area of each end of the delay line. In this area at each end of the delay line a respective coupling conductor is connected to the delay line for supplying and discharging HF energy. In order to achieve a low reflection transition between the surge impedance of the delay line and that of the coupling conductor, in the region of at least one of the two ends of the delay line, a metallic matching component is provided which is peferably spot welded to a surface formed at the diameter enlargement, the matching component including an arm which is spot welded to that surface and projections extending from the arm radially inwardly between adjacent support rods and in close proximity to the delay line. The end surfaces of the projections which face the delay line are darkened to absorb heat radiated by the delay line and discharge the same toward the exterior of the traveling wave tube.

25 Claims, 2 Drawing Figures

TRAVELING WAVE TUBE HAVING A HELIX DELAY LINE

BACKGROUND OF THE INVENTION

1. Field of the Invention

The present invention relates to a traveling wave tube having a delay line in the form of a helix which is supported within a metallic sleeve by a plurality of dielectric support rods which extend along the delay line, the delay line being connected at each end thereof to a respective HF energy supply conductor and discharge conductor, and more particularly to such a delay line in which a matching component is provided in the region of at least one of the ends of the delay line and extending in close proximity to the delay line to achieve a low reflection transition between the surge impedance of the delay line and the respective coupling conductor.

2. Description of the Prior Art

In traveling wave tubes, the surge impedances of the interaction section, on the one hand, and of the coupling conductors (generally rectangular wave guides or coaxial lines), on the other hand, differ from each other and in such a manner that it is usually necessary to take special, impedance-transforming measures in order to reduce the reflection factors of wide-band traveling wave tubes to a viable degree. If the delay line consists of a helix, for purposes of impedance matching, frequently metal rings ($\lambda/4$ transformers) having a length which amounts to approximately one quarter of the average line wave length are placed over the ends of the helix. If transition elements of this kind are to supply favorable matching values, they result in assembly problems and also in production problems as in a narrow space they collide with the support rods, cannot easily be secured, and in practice must frequenty be provided with oblique or curved inner surfaces in an additional operation. For this reason, it has already been disclosed in U.S. Pat. No. 3,729,644 that for impedance transformation the turns of the helix should simply be conductively shunted by a soldered-off longitudinal rod in the region of the coupling conductor. This type of line loading should be comparatively simpler to apply, at least in the case of helical structures of large dimension, but the same is not particularly effective in the case of wide band structures.

SUMMARY OF THE INVENTION

It is the primary object of the invention to provide a traveling wave tube having a helical delay line which is matched to the coupling conductors with low reflection and on a wide-band basis wherein matching is accomplished with a simple structure and at low expense, both in materials and production.

In order to eliminate the above-mentioned difficulties, and in particular in order to provide a traveling wave tube whose helical delay line, preferably a simple coil, is matched to the coupling conductors, as outlined above as the objective of the invention, the present invention provides a matching component in the form of an arm having projections extending therefrom, the arm being fixed to an internal end surface of the metallic sleeve of the traveling wave tube and the projections extending between adjacent support rods and in close proximity to the delay line.

The matching component provided in accordance with the present invention can be applied with ease, and can be fixed, for example, by simple spot welding.

The special form of the matching component does not obstruct the delay line support, and when provided with simple dimensions can even be used as a stop means for the support rods, thus obviating the need for such structure as is conventionally required. Experiments have also proved that the proposed matching component design can actually supply matching values which are satisfactory even over large frequency ranges, such as e.g. an octave.

A matching component developed in accordance with the present invention has a favorable influence not only on the reflection factor, but also on the other tube parameters. On the one hand, in the adjacent line portion the matching component increases the degree of delay of the line wave, and thus it increases a conversion efficiency of the tube in the form of a velocity taper. On the other hand, the solid matching component, in particular when its surfaces which face toward the delay line are darkened, can discharge the heat loss which is developed in the line output and is radiated, to the sleeve on wide, short heat conduction paths, and thus reduce the danger of fading (gradual reduction in the tube output power during operation because of the heating of the delay line).

Particularly favorable transformation conditions are achieved if the coupling conductor is a coaxial line and the delay line is galvanically coupled to this line, where the delay line is electrically conductively connected to the inner conductor and the matching component is electrically conductively connected to the outer conductor of the coaxial line. The best matching values are obtained if the outermost line period (helical turn) is not surrounded by the matching component. The overall transition then acts as a two-stage transformer element which converts the higher surge impedance of the delay line in stepped fashion into the lower surge impedance of the coupling conductor. The first stage is formed by the matching component, and the second stage is formed by the outermost line period together with the electrical connection to the coaxial inner conductor.

BRIEF DESCRIPTION OF THE DRAWINGS

Other objects, features and advantages of the invention, its organization, construction and operation will be best understood from the following detailed description taken in conjunction with the accompanying drawings, on which.

Those components of a traveling wave tube which are not essential for the understanding of the invention, for example the magnet system which serves to guide the electron beam, cooling devices or electrical supply lines have been omitted for the sake of clarity, the same being well understood by those in the art of traveling wave tubes.

DESCRIPTION OF THE PREFERRED EMBODIMENTS

Figure 1:
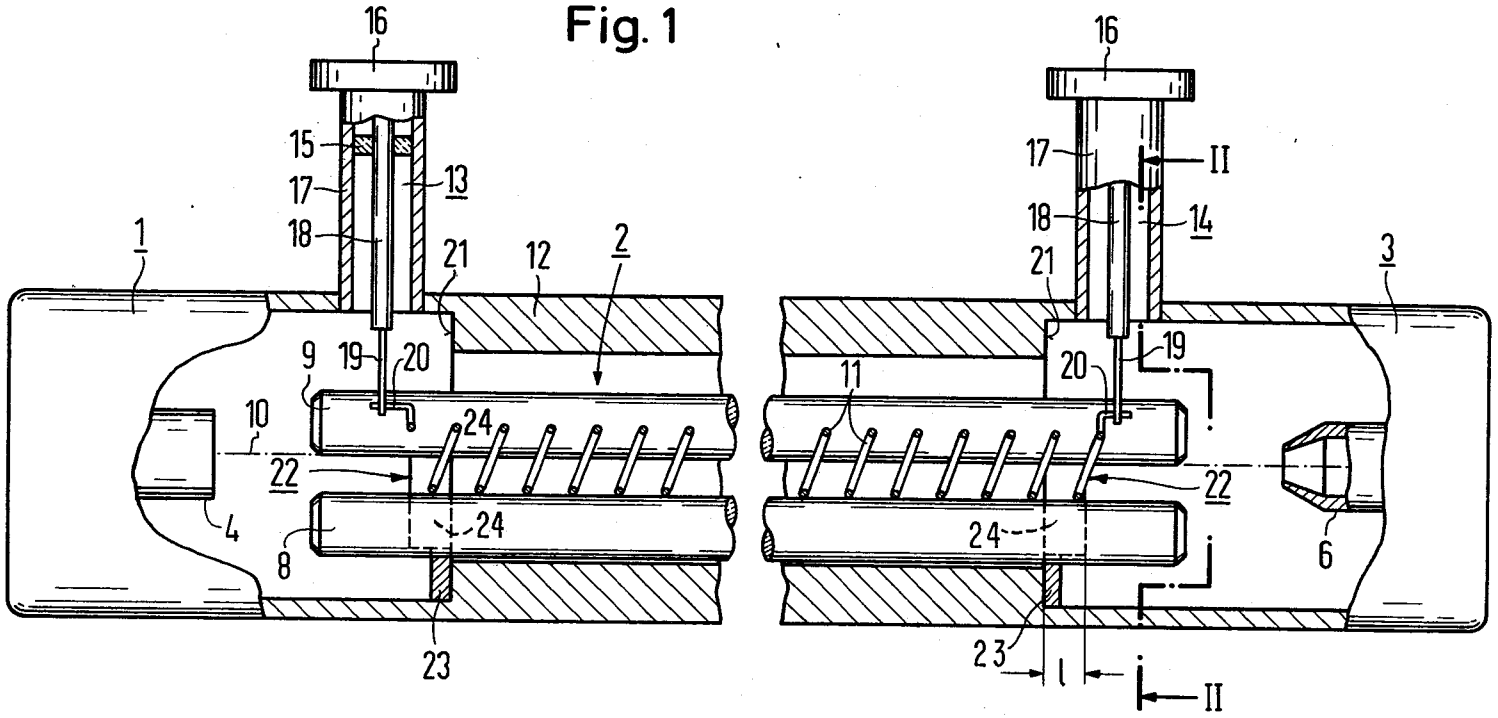
FIG. 1 is a longitudinal view, shown partially in section, of an exemplary embodiment of the traveling wave tube constructed in accordance with the present invention.
Figure 2:
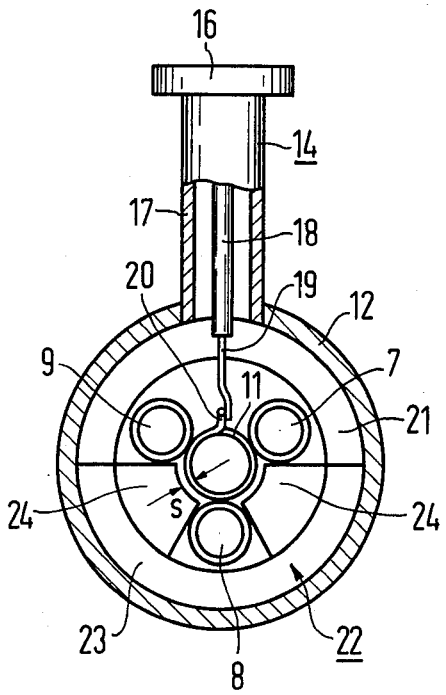
FIG. 2 is a sectional view of the embodiment of the invention illustrated in FIG. 1 and taken substantially along the line II—II.

The traveling wave tube illustrated in FIGS. 1 and 2 comprises an electron beam generating component 1, a central interaction component 2 and an electron beam collector component 3. The electron beam generating component 1 contains an electron beam generating system 4, shown only schematically in FIG. 1, the electron beam collector component 3 contains a collector 6, also only generally illustrated in FIG. 1, and the central component 2 contains a delay line 11, which is supported by three support rods 7, 8 and 9, and in the present case comprises a helix. The central component 2 also includes a guide tube 12 which serves as a vacuum sleeve and surrounds the support rods 7, 8 and 9 and the helix 11. At the input and at the output of the helix 11, respective coaxial lines are provided, a coaxial line 13 for supplying HF energy and a coaxial line 14 for discharging the HF energy. The coaxial lines are inserted in a vacuum-tight fashion into the vacuum sleeve 12. Each of these coaxial lines is likewise sealed in a vacuum-tight fashion by a wave-transmissive window 15, and each terminates in a connection flange 16 and comprises an outer conductor 17 and an inner conductor 18. The coaxial inner conductors 18 are each electrically conductively connected by way of two connection lines 19, 20 to respective ends of the helix 11.

In the regions of the ends of the helix 11, the inner diameter of the vacuum sleeve 12 is stepped to a greater diameter than the central portion of the traveling wave tube, the structure providing a surface 21 which extends at right angles to the longitudinal axis of the tube (line axis 10), and which supports the sleeve matching component which is provided in accordance with the invention and which is referenced 22.

The matching component 22 comprises an arm 23, which arm abuts against the sleeve surface 21 in an internal flush relationship, and a pair of projections 24 which, beginning from the arm 23, extend toward the helix 11. As can be seen in FIG. 1, in the direction of the line axis 10, the arm 23 is very much narrower than the projections 24; the arm is to be as thin as possible to enable the same to be spot welded with the least possible energy consumption and low heat development.

It is advisable to select a range of between approximately 0.1 and 0.3 $\lambda_g$ for the effective length $l$ of the matching component, thus the length of the projections measured in the direction of the line axis, where $\lambda_g$ signifies the shortened wave length on the helix 11. The radical distance $s$ of the projections 24 from the coil 11 is here to amount between 0.02 and 0.15 $\lambda_g$. Independently of this, however, it is always advantageous if, as illustrated, the particular outer turns of the helix are not surrounded by the matching component 22. A matching component dimensioned and positioned in this manner was able to reduce the reflection factor of a traveling wave amplifier over an octave from, on the average, 30% easily to approximately 10%.

The projections 24 of the matching component 22 which extend between the support rods 7, 8 and 8, 9 are dimensioned peripherally in such a manner that they contact all three support rods and thus firmly maintain the support rod 8 and provide a stop surface for the other two support rods 7 and 9. The projection surfaces which face toward the helix 11 are preferably darkened in order to enable the radiation heat emitted by the helix 11 during operation to be absorbed and discharged toward the exterior of the traveling wave tube.

In the present case a non-magnetic material such as constantan, or constantin (Cu 60%, Ni 40%) or molbydenum has been selected for the matching component 22, whose thermal expansion coefficient is not to differ too greatly from that of the vacuum sleeve 12, and is also to deform the magnetic guidance field to the least extent possible. Here, the vacuum sleeve consists of steel $V_{2a}$, the support rods consist of $Al_2O_3$ and the helix consists of molbydenum. If one permits dimensioning tolerances for the helix length, or, more generally, for the difference between the helix length and the distance between the sleeve end faces, these divergences can be compensated in dependence upon the particular circumstances by selecting a suitable matching component from a set of samples of various lengths.

The invention is not limited to the exemplary embodiment illustrated on the drawings. Therefore, it is no way necessary to select a galvanically coupled coaxial line, or always to equip both line junctions with the matching component designed in accordance with the invention. In addition, the traveling wave tube can also contain another delay line, for example a ring-and bar-line, and the delay line can also be supported by more than three support rods. Here, the number of projections of the matching component is not strictly corelated with the number of support rods.

In addition to those changes and modifications set forth above, other changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a traveling wave tube of the type having a helical delay line supported by a plurality of dielectric rods within a metallic sleeve and having coupling conductors connected to respective ends of the delay line to supply and discharge HF energy, respectively, the improvement therein comprising:

means for providing a low reflection transition between the delay line and at least one of the coupling conductors, including, in the area of at least one of the ends of the delay line, a metallic matching component comprising an arm connected to the metallic sleeve and projections extending from said arm and extending between the support rods and in close proximity to the delay line, said projections spaced a distance $s$ from the delay line in accordance with the range relationship $$0.02\ \lambda_g < s < 0.15\ \lambda_g$$

and extending a distance $l$ in the direction of the axis of the delay line in accordance with the range relationship $$0.1\ \lambda_g < l < 0.3\ \lambda_g$$

where $\lambda_g$ is the short wave length of the delay line.

2. The improved traveling wave tube according to claim 1, wherein each of said projections includes a darkened end surface adjacent the delay line to absorb heat radiated from the delay line.

3. The improved traveling wave tube according to claim 1, wherein said arm is narrower in the direction of the longitudinal axis of the delay line than said projections.

4. The improved traveling wave tube according to claim 1, wherein said arm is arcuate and extends about the delay line less than 360°.

5. In an improved traveling wave tube according to claim 1, the further improvement wherein:

the metallic sleeve includes a portion of increased diameter in the area of said one end of the delay line defining a surface normal to the longitudinal axis of the delay line, and said arm is fixed to said surface.

6. In an improved traveling wave tube according to claim 5, the improvement is further defined wherein said arm includes a surface parallel to and abutting said surface which is defined by said increased diameter portion, and said arm is spot welded to the latter-mentioned surface of the metallic sleeve.

7. The improved traveling wave tube according to claim 1, wherein each of said projections extend between and contact adjacent ones of the support rods.

8. A traveling wave tube comprising:

a metallic sleeve including a first portion of a first inner diameter, at least one second portion of a greater second diameter and a surface at the junction of said first and second portions;

a electron beam generator in one end of said sleeve and an electron beam collector in the other end of said sleeve;

a delay line extending through said first portion;

input and output coupling conductors coupled to respective ends of said delay line for supplying and discharging HF energy; and at least one metallic matching component in said second portion of said sleeve for matching the surge impedances of said delay line and the respective coupling conductor coupled to that end of said delay line, said component comprising an arm secured to said surface and projections extending toward and in close proximity to said delay line, said projections extending radially inwardly to a point in the range of 0.02–0.15 $\lambda_g$ from the delay line and in the axial direction of said delay line a distance in the range of 0.1–0.3 $\lambda_g$, where $\lambda_g$ is the shortened wave length on said delay line.

9. The traveling wave tube of claim 8, wherein said projections extend a greater distance along the axial direction of said delay line than said arm.

10. The traveling wave tube of claim 8, wherein each of said coupling conductors comprises a coaxial line having an inner conductor and an outer conductor said inner conductor electrically connected to the respective end of said delay line and said outer conductor electrically connected to said matching component via said sleeve.

11. The traveling wave tube of claim 8, wherein said delay line is a helix, and said matching component is arcuate shaped and partially surrounds the outermost turn of said delay line helix.

12. The traveling wave tube of claim 8, comprising:

spot weld connections securing said arm of said matching component to said surface.

13. The traveling wave tube of claim 8, wherein said delay line generates heat and said projections each comprise:

a darkened end surface facing said delay line to absorb heat radiated by said delay line.

14. The traveling wave tube of claim 8, wherein said delay line comprises:

a helix having one end electrically connected to one of said coupling conductors and the other end electrically connected to the other of said coupling conductors; and a plurality of dielectric support rods spaced about, extending along and supporting said helix, said projections extending between adjacent support rods.

15. The traveling wave tube of claim 14, wherein each of said projections contacts each of said support rods which are adjacent thereto.

16. The traveling wave tube of claim 14, wherein said support rods are spaced at 120° about said helix, said coupling conductors extend radially outwardly of said sleeve at approximately 180° of one of said support rods, and said one support rod is contacted and extends between two of said projections.

17. A traveling wave tube comprising:

a metallic sleeve including a first portion of a first inner diameter, second and third portions each having a greater second inner diameter at opposite ends of said first portion, and first and second surfaces at the respective junctions of said first and second portions and said first and third portions, said surfaces extending perpendicular to the longitudinal axis of said sleeve;

an electron beam generator in said second portion and an electron beam collector in said third portion;

a coaxial input coupling for coupling in HF energy, including an inner conductor, and including an outer conductor electrically connected to said sleeve at said second portion;

a coaxial output coupling for coupling out HF energy, including an inner conductor, and including an outer conductor electrically connected to said sleeve and said third portion;

a helical delay line extending through said first portion and having opposite ends extending into said second and third portions, repectively, said ends electrically connected to respective inner conductors of said coaxial input and output couplings;

a plurality of dielectric support rods spaced about to support and extend along said helical delay line; and a pair of metallic matching components at respective ends of said delay line for matching the surge impedance of said couplings and said delay line, each of said matching components comprising an arm electrically connected and mechanically fixed to a respective one of said first and second surfaces, and projections extending from said arm between adjacent ones of said support rods and in close proximity to said delay line, said projections extending to a point which is spaced from said delay line in the range of 0.02 to 0.15 $\lambda_g$, and said projections extending in the axial direction a distance in the range of 0.1 to 0.3 $\lambda_g$, where $\lambda_g$ is the shortened wave length on said delay line.

18. The traveling wave tube of claim 17, comprising at least one conductor extending between and electrically connecting an inner coaxial conductor with the respective end of said helical delay line.

19. The traveling wave tube of claim 17, wherein each of said projections includes a darkened surface facing said delay line to absorb heat radiated by said delay line.

20. The traveling wave tube of claim 17, wherein each of said matching components is arcuate shaped and only partially surrounds the respective end of said helical delay line.

21. The traveling wave tube of claim 17, comprising: spot weld connections securing said arms of said matching components to the respective first and second surfaces.

22. The traveling wave tube of claim 17, wherein said plurality of dielectric support rods comprises three such rods spaced apart 120° about said helical delay line, said projections comprises two such projections extending on each side of one of said support rods and contacting each of said support rods, and the connections of said inner coaxial conductors and said delay line are at 180° with respect to said one support rod.

23. The improved traveling wave tube according to claim 1, wherein said matching component does not surround the outermost turn of said delay line helix.

24. The traveling wave tube of claim 8, wherein said matching component does not surround the outermost turn of said delay line helix.

25. The traveling wave tube of claim 17, wherein said matching component does not surround the outermost turn of said delay line helix.

* * * * *